US011072468B2

(12) United States Patent
Than-Aye

(10) Patent No.: US 11,072,468 B2
(45) Date of Patent: Jul. 27, 2021

(54) CONTAINER WITH SECURITY LOCK

(71) Applicant: KC Than-Aye, Sydney (AU)

(72) Inventor: KC Than-Aye, Sydney (AU)

( * ) Notice: Subject to any disclaimer, the term of this patent is extended or adjusted under 35 U.S.C. 154(b) by 149 days.

(21) Appl. No.: 16/438,724

(22) Filed: Jun. 12, 2019

(65) Prior Publication Data

US 2020/0391911 A1 Dec. 17, 2020

(51) Int. Cl.
*B65D 50/04* (2006.01)

(52) U.S. Cl.
CPC ..... *B65D 50/046* (2013.01)

(58) Field of Classification Search
CPC ..... B65D 53/04; B65D 83/04; B65D 50/046; B65D 50/048; B65D 50/045; B65D 50/04; B65D 50/06; B65D 50/061; B65D 25/101; B65D 43/021; B65D 45/08; B65D 45/025; B65D 45/22; B65D 45/28; B65D 45/16; B65D 55/04; E05B 73/0023
See application file for complete search history.

(56) References Cited

U.S. PATENT DOCUMENTS 943,825 A * 12/1909 Hardinge ..... B65D 47/121 222/153.01
1,138,562 A * 5/1915 Herbolt ..... B65D 83/0481 206/540
1,463,059 A * 7/1923 Matthews ..... B65D 25/101 217/64
2,078,096 A * 4/1937 Parkin ..... A45D 33/006 220/523
3,297,187 A * 1/1967 Thiesen ..... B65D 45/325 215/272
3,466,710 A * 9/1969 Kupersmit ..... B65D 45/16 24/347
3,561,591 A * 2/1971 Henderson ..... B65D 47/283 206/540
3,618,814 A * 11/1971 Nagroski ..... B65F 1/16 220/804
3,827,130 A * 8/1974 Baumann ..... B23P 17/00 29/421.1
3,915,359 A * 10/1975 Feldman ..... B65D 55/02 222/514
4,381,063 A * 4/1983 Leong ..... H02B 1/066 174/67
4,460,106 A * 7/1984 Moulding, Jr. .... B65D 83/0409 221/1

(Continued)

FOREIGN PATENT DOCUMENTS

GB 571264 A * 8/1945 ..... B65D 55/04
WO WO-2008113694 A1 * 9/2008 ..... B65D 83/0463
WO WO-2012115905 A2 * 8/2012 ..... B65D 50/046

*Primary Examiner* — J. Gregory Pickett
*Assistant Examiner* — Abigail Elizabeth Guidry
(74) *Attorney, Agent, or Firm* — Justin Lampel

(57) ABSTRACT

A container with a security lock is provided. The container has a top unit and a bottom unit. A curved compression spring is attached to the bottom unit and surrounds a portion of the circumference of a liner of the bottom unit. The compression spring has two bumps (or knobs) which extend out from openings of the bottom unit and lock into openings of the top unit when the top unit is secured to the bottom unit. When the knobs are pressed in, the top unit may be rotated and removed from the bottom unit.

13 Claims, 11 Drawing Sheets

(56) References Cited

U.S. PATENT DOCUMENTS 4,774,063 A * 9/1988 Runnells ..... A61L 2/26 220/324
5,118,144 A * 6/1992 Garofalo, Jr. ..... B65D 45/22 220/324
5,411,157 A * 5/1995 King ..... B65D 51/20 215/330
5,520,296 A * 5/1996 Freed ..... A61J 7/04 116/308
5,673,807 A * 10/1997 Valyi ..... B29C 57/12 215/232
5,908,037 A * 6/1999 Pierson ..... A45D 33/006 132/293
6,789,393 B2 * 9/2004 Dais ..... B65D 43/021 62/112
7,319,193 B2 * 1/2008 Halterman ..... H02G 3/185 174/482
8,875,877 B2 * 11/2014 Cottle ..... B65D 50/04 206/265
9,334,082 B2 * 5/2016 D'Anglade ..... B65D 15/04
9,731,876 B1 * 8/2017 Giraud ..... B65D 43/22
9,738,426 B1 * 8/2017 Giraud ..... B65D 43/22
2005/0092708 A1 * 5/2005 Heisner ..... B65D 1/0223 215/384
2010/0000888 A1 * 1/2010 Cronin ..... A24F 23/00 206/265
2011/0036743 A1 * 2/2011 Wharton ..... B65D 11/12 206/531
2012/0260612 A1 * 10/2012 Cronin ..... B65D 83/04 53/492
2012/0261418 A1 * 10/2012 Cronin ..... B65D 50/046 220/277
2016/0360783 A1 * 12/2016 Patel ..... B29C 41/22
2020/0346820 A1 * 11/2020 Sa ..... B65D 25/18

* cited by examiner

CONTAINER WITH SECURITY LOCK

BACKGROUND OF THE INVENTION

A container with a security lock is provided. The container has a top unit and a bottom unit. A curved compression spring is attached to the bottom unit and surrounds a portion of the circumference of a liner of the bottom unit. The compression spring has two bumps (or knobs) which extend out from openings of the bottom unit and lock into openings of the top unit when the top unit is secured to the bottom unit. When the knobs are pressed in, the top unit may be rotated and removed from the bottom unit.

Containers with security locks are known. For example, U.S. Pat. No. 9,481,496 to Cottle discloses a child resistant container for nicotine products. The container comprises latching elements adapted to interlock with cooperating latching elements when said lid is pushed onto a said base to retain said lid to said base. The latching elements are further adapted to disengage from said cooperating latching elements when a simultaneous force is exerted on all releasable latching arrangements by two hands of a user or the like.

Further, U.S. Pat. No. 9,187,220 to Biesecker discloses a cap having a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

Still further, U.S. Pat. No. 8,931,657 to Kientzle discloses a pharmaceutical container having a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

However, these patents fail to describe a container with a security lock which is easy to use. Further, these patents fail to provide for a container with a security lock which allows a user to unlock a child-resistant container in a simple and safe manner.

SUMMARY OF THE INVENTION

A container with a security lock is provided. The container has a top unit and a bottom unit. A curved compression spring is attached to the bottom unit and surrounds a portion of the circumference of a liner of the bottom unit. The compression spring has two bumps (or knobs) which extend out from openings of the bottom unit and lock into openings of the top unit when the top unit is secured to the bottom unit. When the knobs are pressed in, the top unit may be rotated and removed from the bottom unit.

An advantage of the present child resistant storage container is that the present child resistant storage container is easy to use for adults while preventing children from gaining access to the interior of the container. The device is especially suitable for seniors which typically have difficulty opening child resistant containers.

Still another advantage of the present child resistant storage container is that the present container lacks exterior sharp edges and corners which may otherwise injure someone.

For a more complete understanding of the above listed features and advantages of the container with a security lock reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A container with a security lock is provided. The container has a top unit and a bottom unit. A curved compression spring is attached to the bottom unit and surrounds a portion of the circumference of a liner of the bottom unit. The compression spring has two bumps (or knobs) which extend out from openings of the bottom unit and lock into openings of the top unit when the top unit is secured to the bottom unit. When the knobs are pressed in, the top unit may be rotated and removed from the bottom unit.

Figure 1:
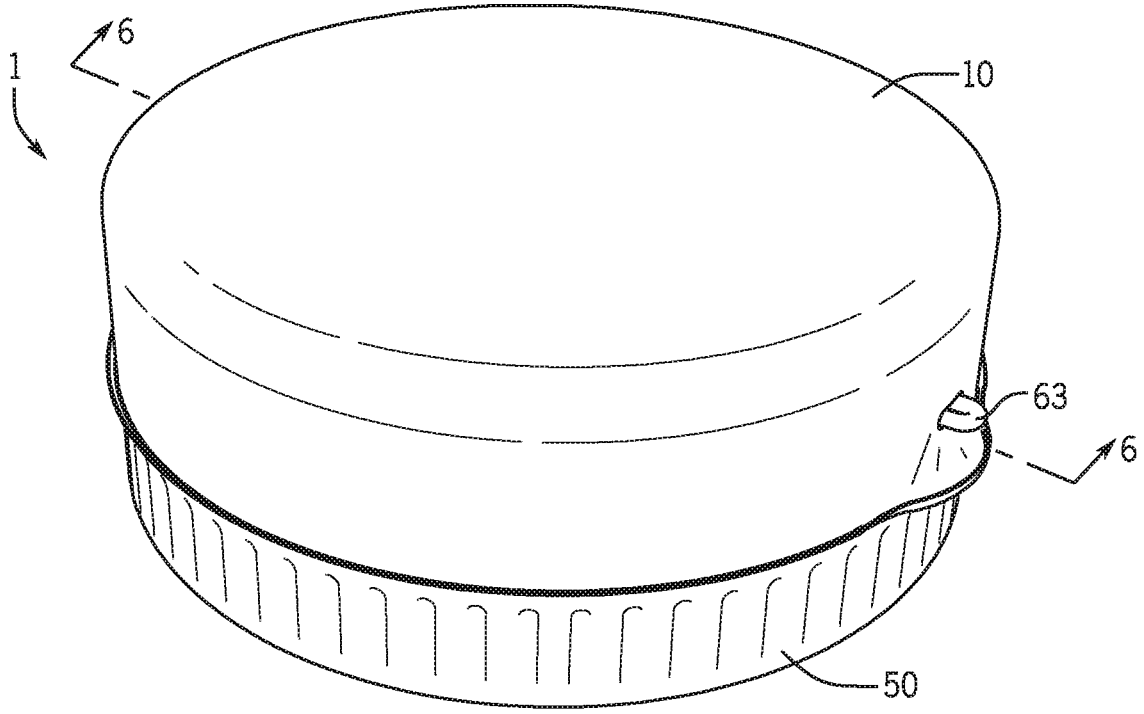
FIG. 1 illustrates a perspective view of the container with a security lock wherein the top unit is secured to the bottom unit in the closed form.
Figure 2:
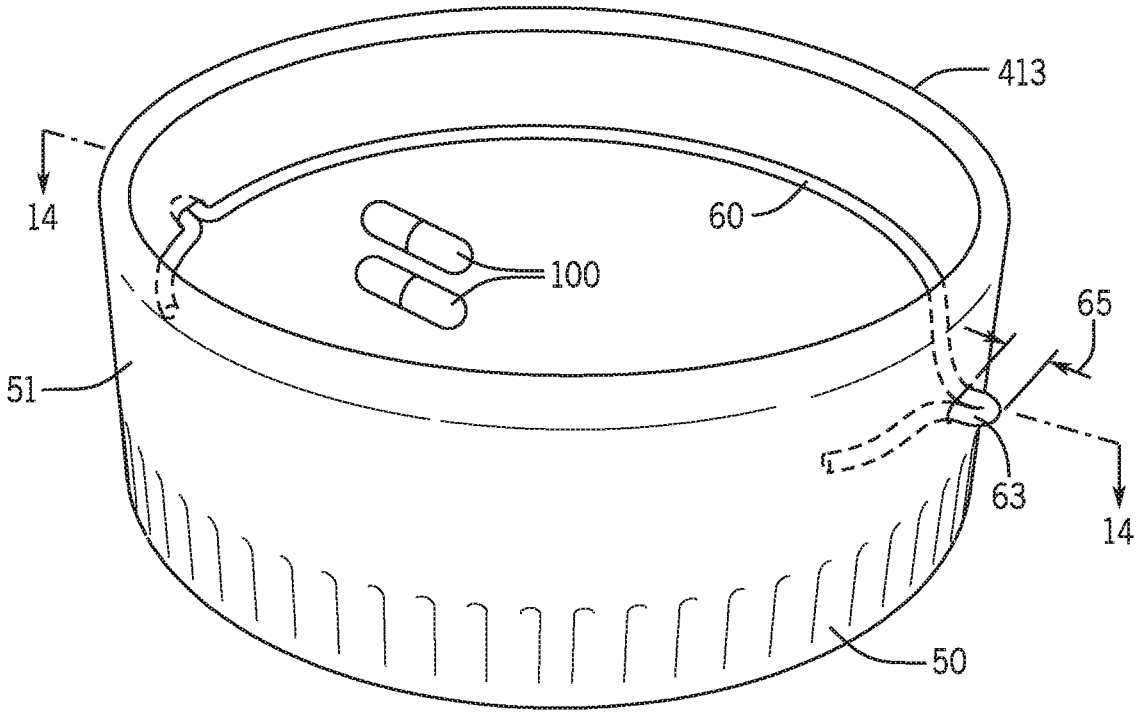
FIG. 2 illustrates a perspective view of the bottom unit of the container with a security lock wherein the top unit is removed.

Referring first to FIGS. 1 and 2, in an embodiment a secured container 1 is provided. The container 1 may have a top unit 10 and a bottom unit 50. The container 1 may be especially suitable for securing an item 100, such as medication, which can potentially be harmful to individuals, such as children, whom might otherwise gain access to the medicine from a non-secure container. In an embodiment, the container 1 is largely made of a durable material, such as plastic and/or metal. In one embodiment, the container 1 is largely made of tin. The container 1 is especially suitable for preventing children from accessing the contents 100 of the container 1 when the container 1 is sealed.

Figure 11:
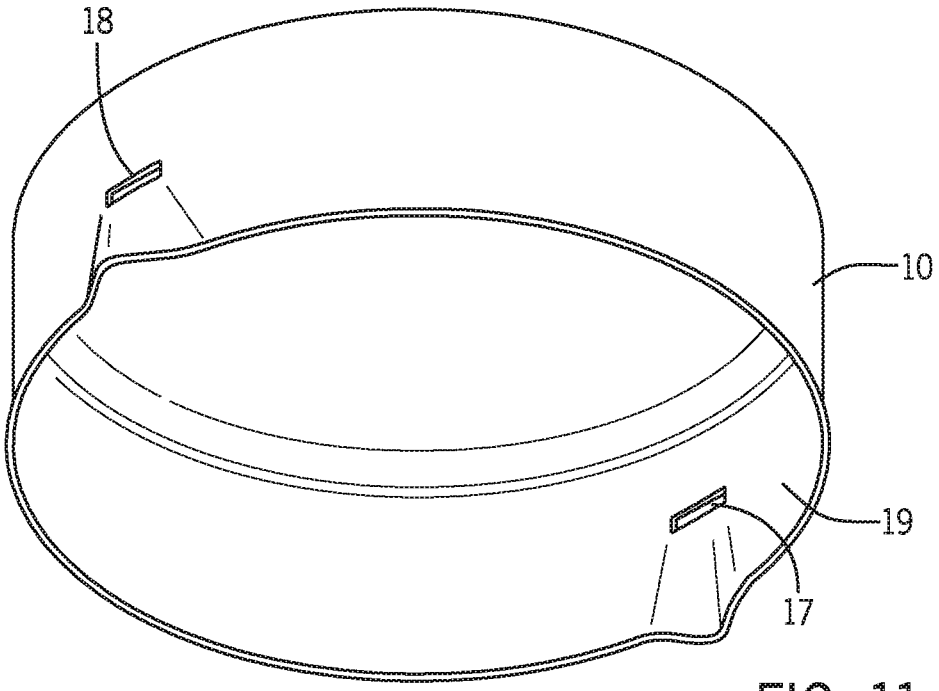
FIG. 11 illustrates a view of the underside of the top unit.

In an embodiment, the top unit 10 may have a top surface 11 (FIG. 3), a bottom 12 and a generally cylindrical side 13. The bottom 12 of the top unit 10 may have an opening 19 (FIG. 11). The top unit 10 may have a diameter 16 (FIG. 4). In an embodiment, the generally cylindrical side 13 of the top unit 10 may have a first opening 17 and a second opening 18 (FIG. 11) wherein the first opening 17 and the second opening 18 are, in one embodiment, located approximately one hundred and eighty degrees apart from each other on opposite sides of the side 13 of the top unit 10.

Figure 3:
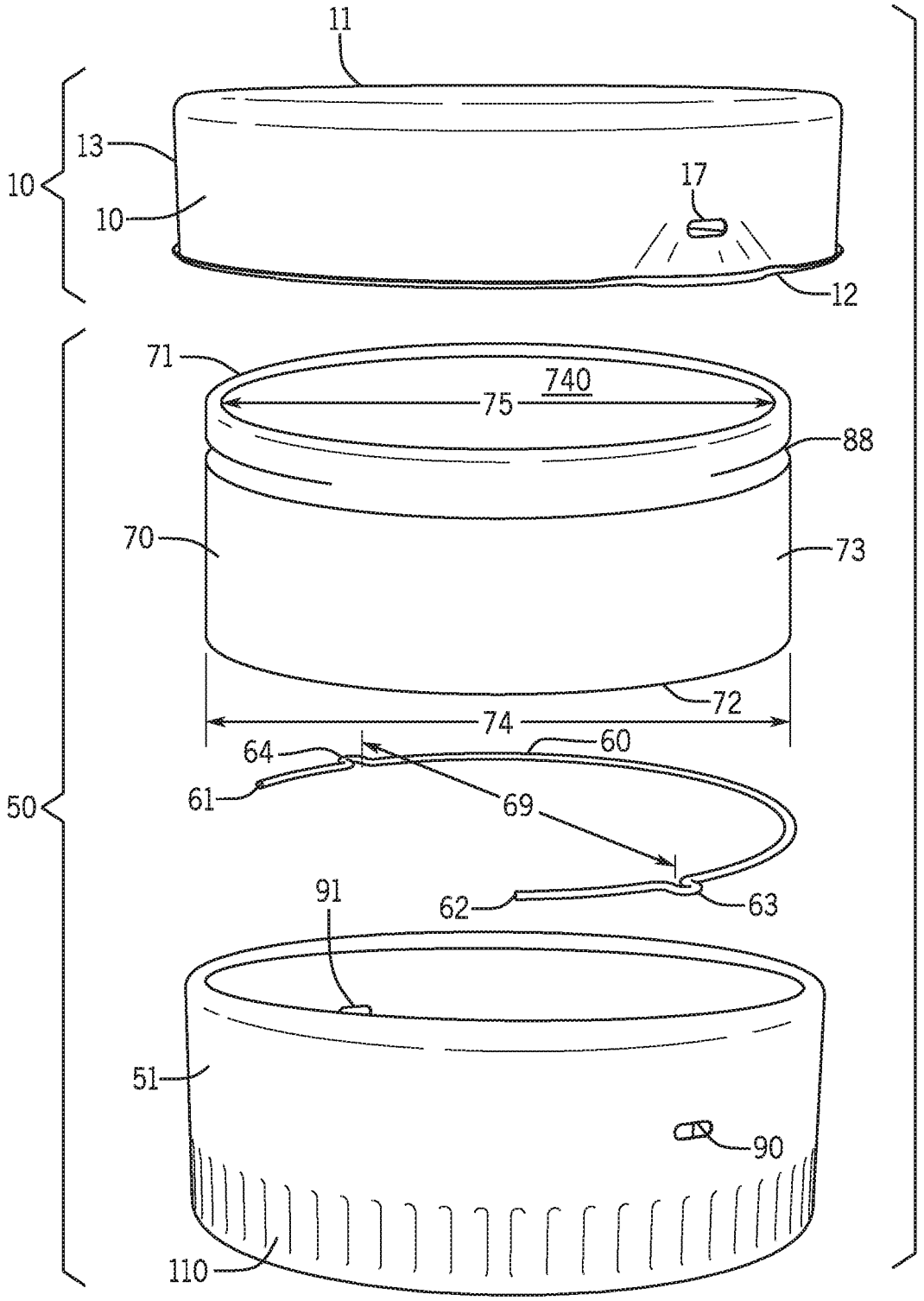
FIG. 3 illustrates an exploded view of the container with a security lock wherein the units are separated from each other.
Figure 4:
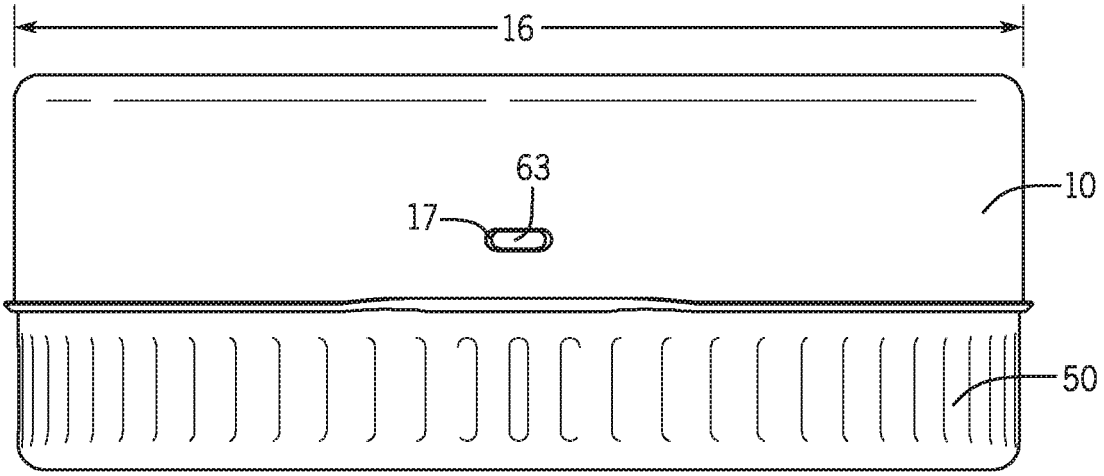
FIG. 4 illustrates a front view of the container with a security lock wherein the top unit is secured to the bottom unit.
Figure 5:
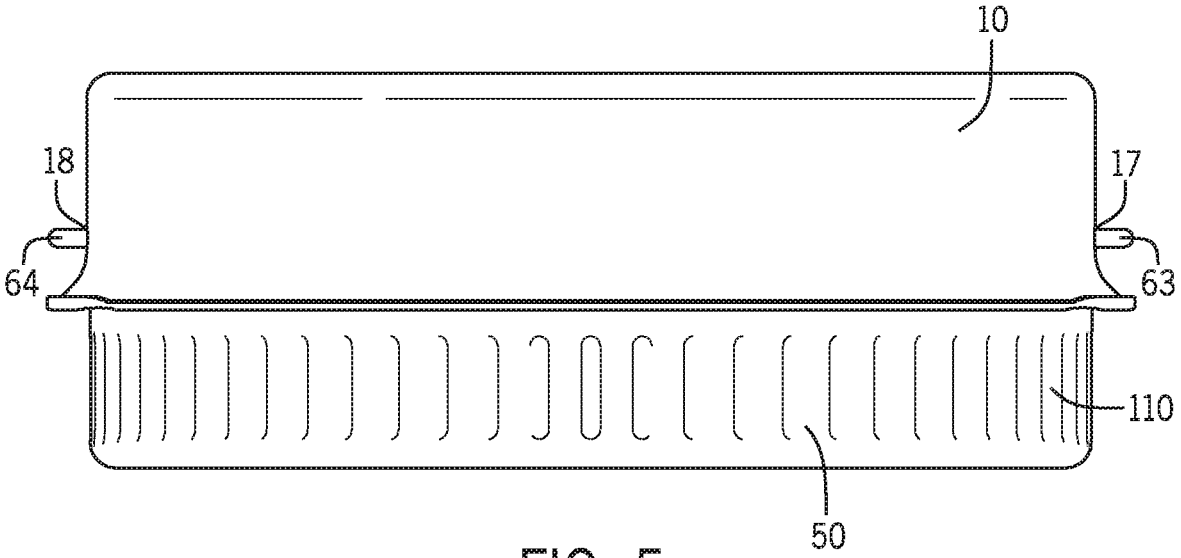
FIG. 5 illustrates a side view of the container with a security lock wherein the top unit is secured to the bottom unit.

As best illustrated in FIG. 3, in an embodiment, the bottom unit 50 of the container 1 may be made of three components. In particular, the bottom unit 50 may have a generally cylindrical exposed, exterior surface 51, an interior liner 70 and a compression spring 60 which is located between the exterior surface 51 and the interior liner 70. In an embodiment, the interior liner 70 has a top lip 71, a bottom 72, a cylindrical side 73 and an interior 740 for storing items 100. The bottom 72 of the liner 70 has a diameter 74 and the top of the liner 70 has a diameter 75. The top 71 of the liner 70 may have a rim 76 (FIG. 7) which is located above a slightly indented portion 88 of the liner 70. In an embodiment, the liner 70 is durable, yet flexible. Preferably, the liner 70 is made of a thin metal or plastic which can be bent, but which retains its shape once pressure is released.

In an embodiment, the spring 60 may have a first end 61 and a second end 62 and may be generally curved. The spring 60 may also have a first extended bump 63 and a second extended bump 64. The extended first bump (or knobs) 63 and extended second bump 64 may extend away from (or exterior to) the main curve of the spring 60 a short length 65 (FIG. 2). The first bump 63 and the second bump 64 are located approximately one hundred and eighty degrees away from each other with respect to the curved spring 60. The first end 61 and the second end 62 of the spring 60 may be less than one hundred and eighty degrees apart so that the spring 60 is extends a circumference greater than half a circle. The spring 60 is preferably made of a durable, yet bendable material such as a metal.

Figure 9:
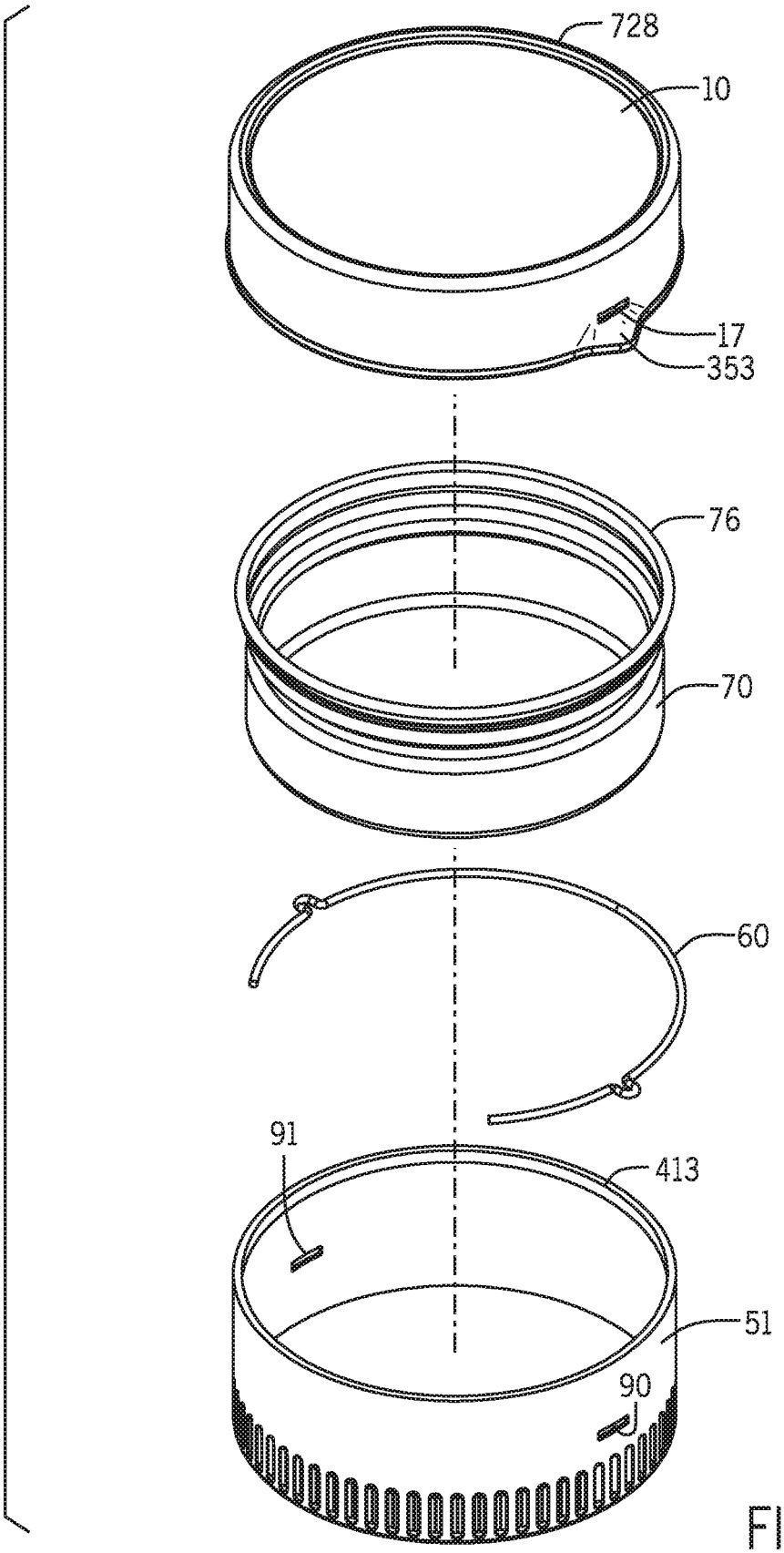
FIG. 9 illustrates an exploded view of the container with a security lock.
Figure 10:
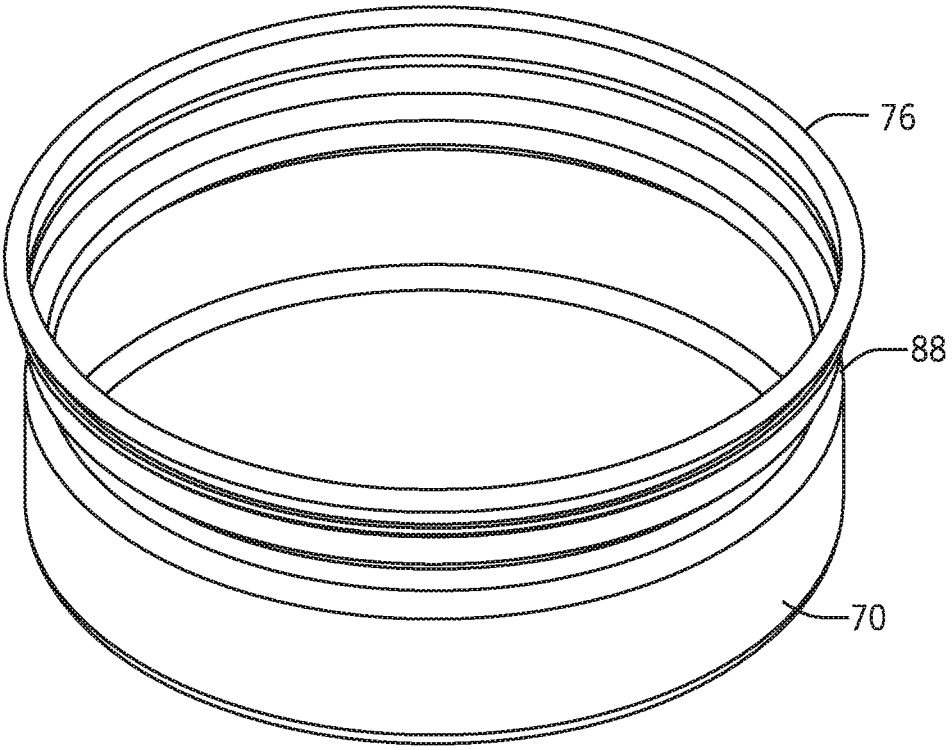
FIG. 10 illustrates a view of the liner of the bottom unit of the container with a security lock in an embodiment.

In an embodiment, the exterior surface 51 of the bottom unit 50 may have a first opening 90 and a second opening 91 (FIG. 9). The exterior surface 51 of the bottom unit 50 may also have, in one embodiment, a ribbed portion 110. The ribbed portion 110 may allow the container 1 to be more easily grasped and twisted by a user (as discussed below).

In an embodiment, the spring 60 wraps partially around the side 73 of the liner 70. In an embodiment, the spring 60 is held in place by the slightly indented portion 88 of the liner 70 and, therefore, the spring 60 is prevented from moving either up or down with respect to the liner 70. The liner 70 may be located within an interior diameter 69 of the spring 60. Lightly compressing the spring 60 therein slightly bends the sides 73 of the liner 70 slightly inward at the compressed area. The exterior surface 51 of the bottom unit 50 therein houses and secures both the spring 60 and the liner 70 so that the spring 60 is locked into place between the liner 70 and the exterior surface 51 of the bottom unit 50 of the container 1. The first bump 63 and the second bump 64 of the spring 60 may be inserted through the openings 90, 91 of the exterior surface 51 of the bottom unit 50 and may stick out from the exterior surface 51 as shown in FIG. 2. In an embodiment, only the first bump 63 and the second bump 64 of the spring 60 is therefore visible on the container 1.

Figure 12:
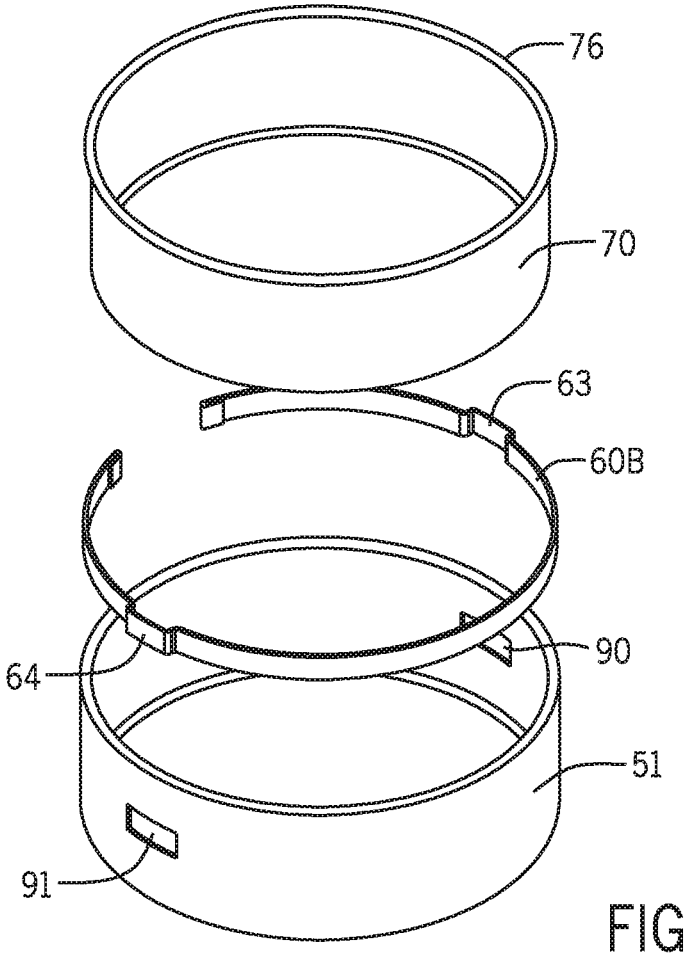
FIG. 12 illustrates an embodiment wherein the spring is generally flat in another embodiment.

In an alternative embodiment from that shown in FIG. 3 as being round, the spring 60B may be generally flat (as shown in FIG. 12). The generally flat shape of the spring 60B in this embodiment may allow a user to more easily compress the spring 60B. Otherwise, the spring 60B of FIG. 12 may therefore operate largely in the same manner as the spring 60 of FIG. 3.

In an embodiment, the spring 60, the liner 70 and the exterior surface 51 all are locked together and form the bottom unit 50, as shown in FIG. 2. In particular, a user may not remove the spring 60 or the liner 70 from the bottom unit 50. The removable top unit 10 may be secured to or removed from the bottom unit 50. In particular, the first and the second openings 17, 18 of the top unit 10 may receive the bumps 63, 64 of the spring 60 and may prevent the top unit 10 from rotating and becoming separated from the bottom unit 50 when the bumps 63, 64 are located in the openings 17, 18 of the top unit 10. By pressing the bumps 63, 64 of the spring 60 together with ones hands, the bumps 63, 64 are forced back through the openings 17, 18 of the top unit 10 and the top unit 10 may then either be pulled off the bottom unit 50 or may then be rotated (by means of a threaded system) and then removed from the bottom unit 50.

Figure 13:
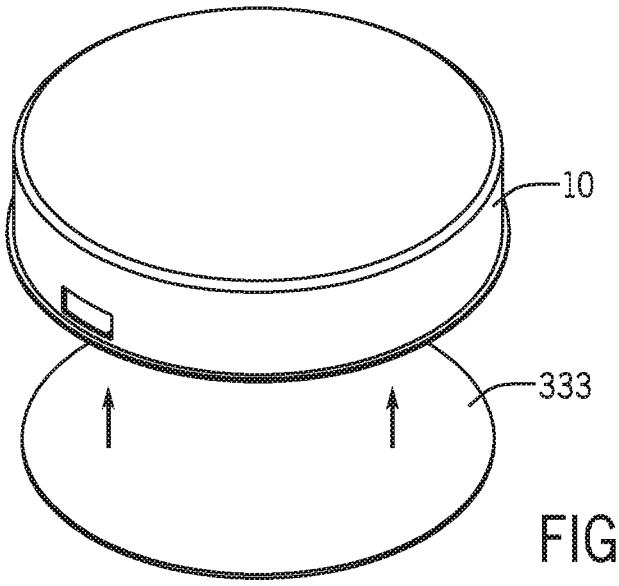
FIG. 13 illustrates an embodiment wherein the top unit has a protective insert.

In an embodiment, the top unit 10 may have a removable liner 333 (FIG. 13). The removable liner 333 may protect the contents of the interior 740 of the liner 70 of the container 1. The removable liner 333 may create an airtight seal between the top unit 10 and the liner 70 when the top unit 10 is secured to the bottom unit 50 during use. In particular, the pressure pushing down from the top unit 10 onto the liner 70 of the bottom unit 50 may allow the removable liner 333 to act as a gasket, creating an airtight seal between the top unit 10 and the bottom unit 50 when the container 1 is sealed.

Figure 15:
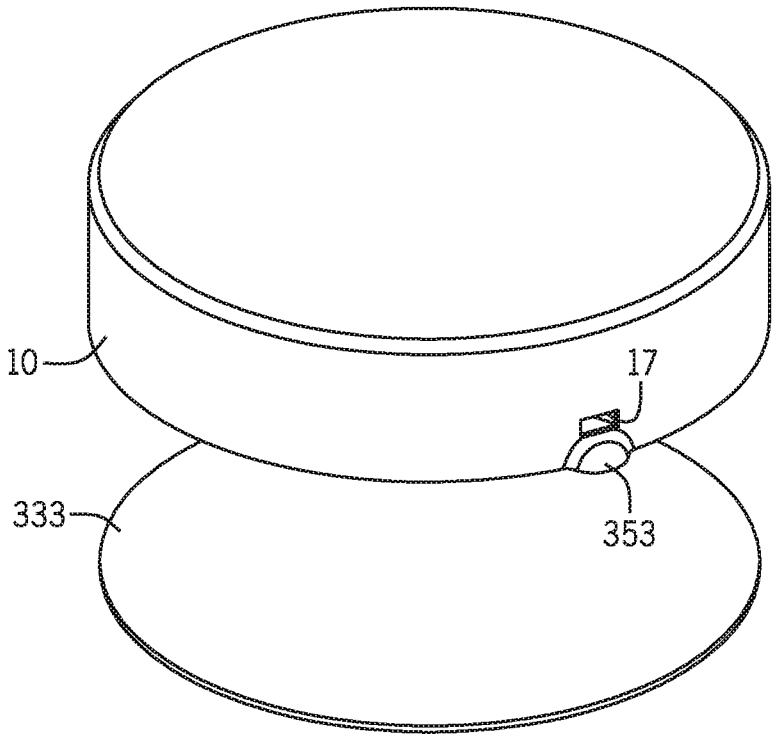
FIG. 15 illustrates an alternative embodiment wherein the top unit has an extended protrusion for easily separating the top unit from the bottom unit.
Figure 16:
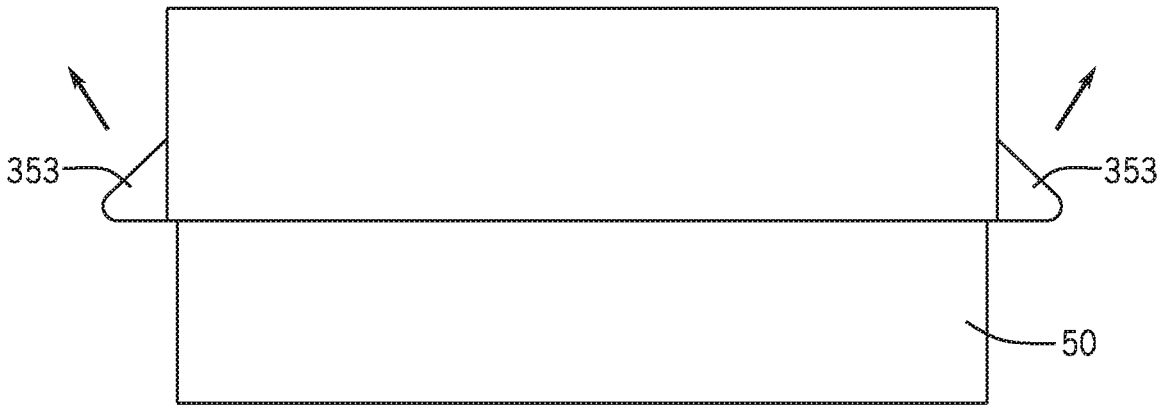
FIG. 16 illustrates a side view of the embodiment wherein the top unit has an extended protrusion.
Figure 17:
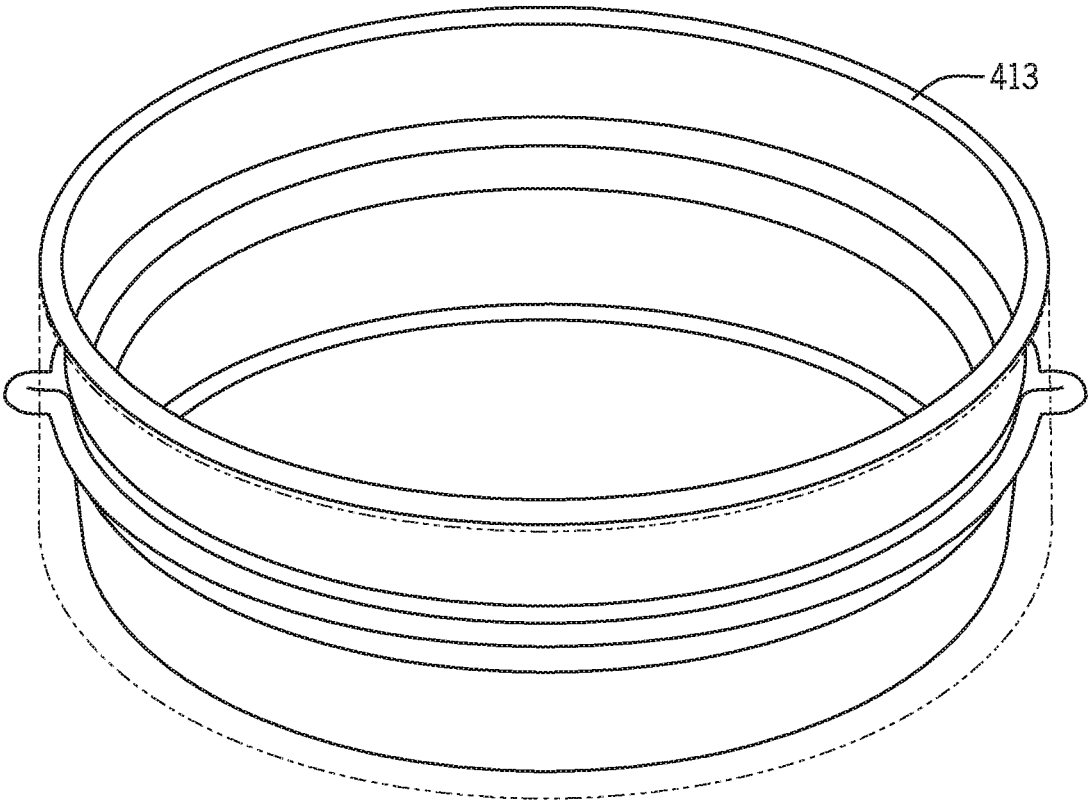
FIG. 17 illustrates an embodiment of the bottom unit wherein the spring and liner are visible through the exterior surface of the bottom unit.

Further, in one alternative embodiment, the top unit 10 may have extended protrusions 353 (FIGS. 15 and 16). The extended protrusions 353 may allow a user to more easily grasp the top unit 10 and pull away the top unit 10 to separate the top unit 10 from the bottom unit 50. In an embodiment, the extended protrusions 353 may be located, for example, directly above or directly below the openings 17, 18 of the top unit 10 so as to better allow the top unit 10 to be separated from the bottom unit 50 (FIG. 15 illustrates the extended protrusions 353 located below the openings 17). In an embodiment, the extended protrusions 353 may allow a user to more easily pull the top unit 10 away from the spring 60 bumps 63, 64 so that the spring bumps 63, 64 are no longer located in the openings 17, 18 of the top unit 10.

Figure 14:
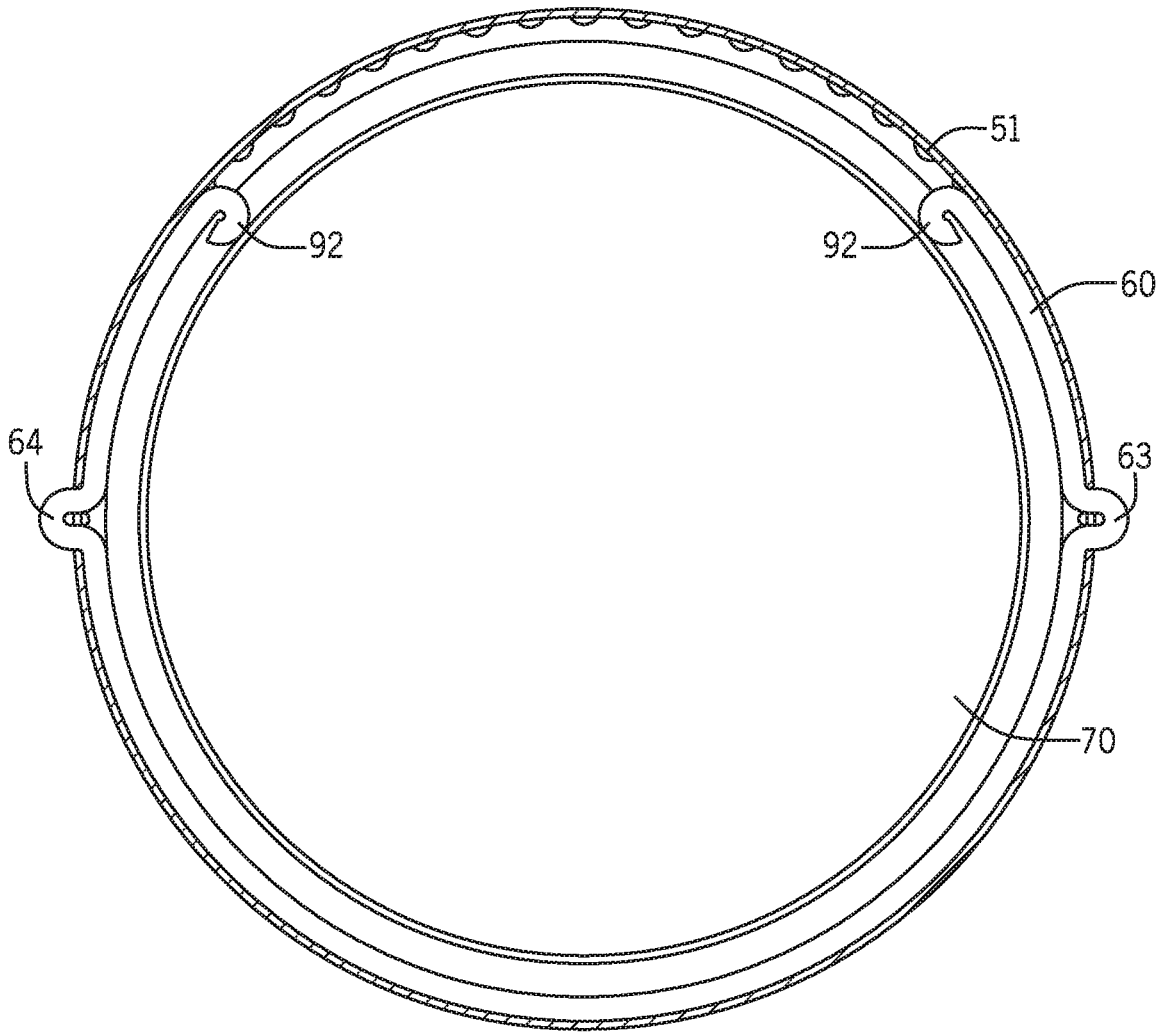
FIG. 14 illustrates a cross-sectional view of the bottom unit of the device in an embodiment.

In an embodiment, the ends of the spring 60 may have curved terminal ends 92 which curve inward toward the liner 70 (FIG. 14). The curved terminal ends 92 may allow the spring 60 to be properly positioned between the liner 70 and the bottom unit 50 and may also help to force the bumps 63, 64 out of the openings 90, 91 of the bottom unit 50 by pushing the spring 60 outward from the liner 70.

Figure 7:
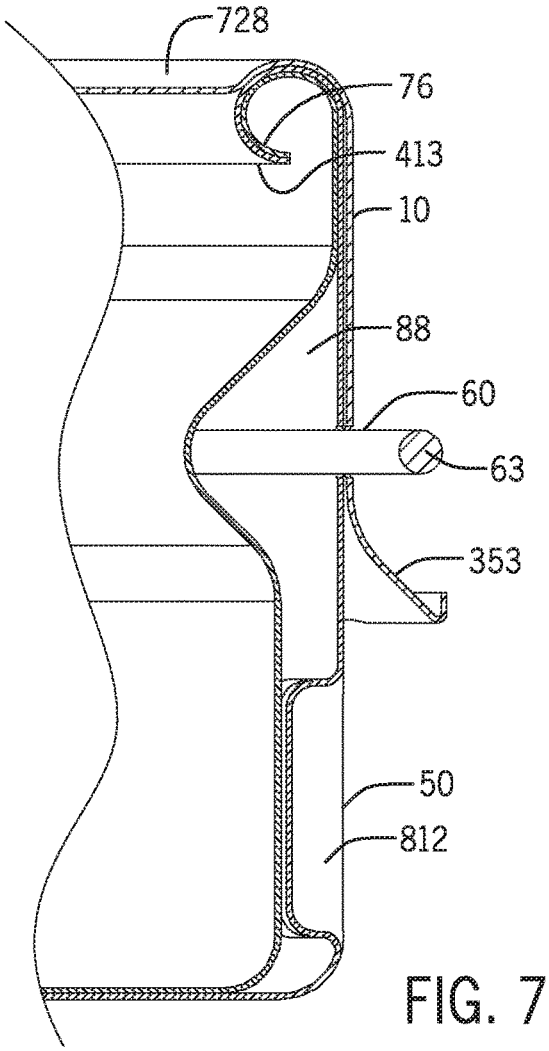
FIG. 7 illustrates a detailed cross-sectional view of the side of the container with a security lock wherein the top unit is locked to the bottom unit.
Figure 8:
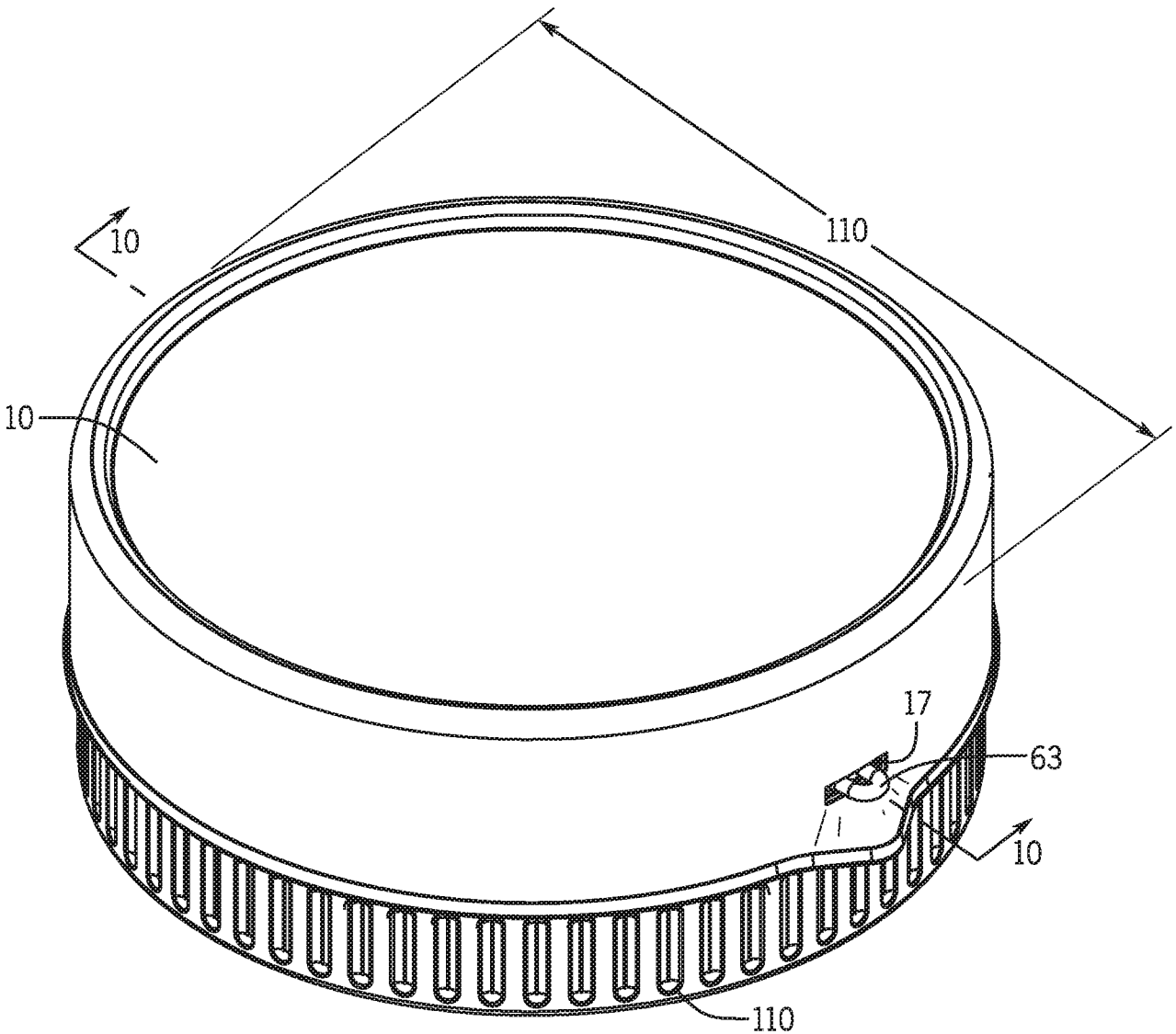
FIG. 8 illustrates a perspective view of the top of the container with a security lock wherein the top unit and bottom unit are locked together.

In an embodiment, as shown in FIG. 7, a hollow interior protrusion 812 may be located on the inside surface of the exterior bottom surface 51. The hollow interior protrusion 812 may allow the liner 70 to be properly positioned within the interior of the exterior bottom surface 51. Further, the hollow interior protrusion 812 may provide additional space for the spring 60 to be located around the liner 70. In an embodiment, the interior protrusion 812 also acts as the ribbed portion 110 of the exterior 51 of the bottom unit 50.

Figure 6:
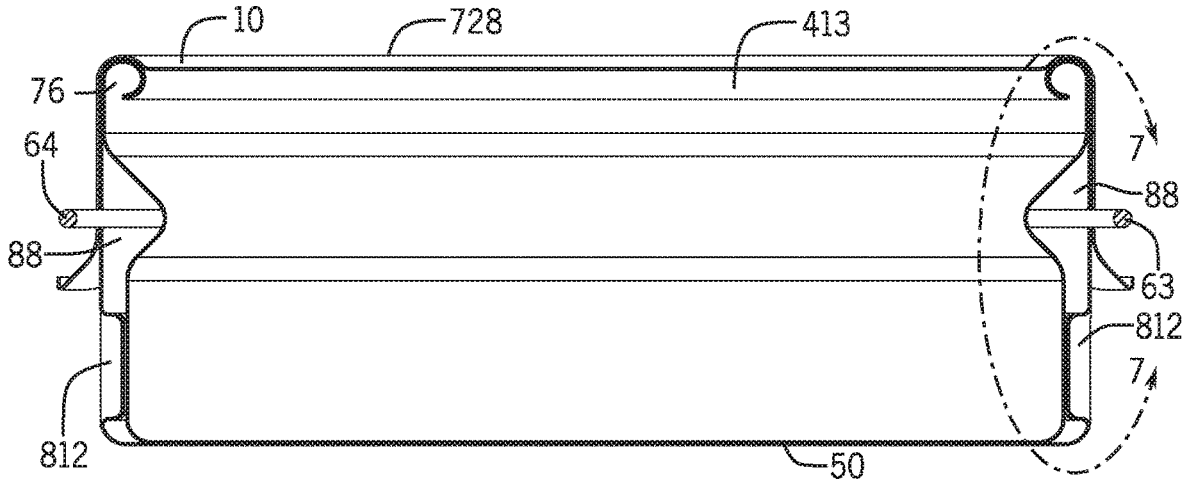
FIG. 6 illustrates a cross-sectional side view of the container with a security lock wherein the top unit is locked to the bottom unit.

Finally, in an embodiment, the top rim 76 of the liner 70 may be permanently sealed and secured under a top rim 413 of the exterior bottom unit 51 in an air-tight and/or liquid tight manner to protect the contents 100 of the interior of the container 1. As illustrated in FIGS. 6 and 7, the top rim 413 of the exterior bottom unit 51 may tightly grasp and secure, in an airtight manner, the top rim 76 of the liner 70. As a result, the liner 70 is locked within the exterior bottom unit 51. Further, in an embodiment, the top unit 10 (or cap) may have an exterior rim 728 (having an underside) which also mirrors and tightly grasps the rim 413 of the exterior bottom unit 51 when the top unit 10 is secured to the bottom unit 50.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A container for storing items comprising:

a top unit having a top surface, a bottom, a side and an interior;

a bottom unit wherein the bottom unit and top unit are capable of temporarily being secured together;

wherein the bottom unit has an exterior surface having a side, a spring and a liner and wherein the spring is located between the exterior surface and the liner; and wherein a portion of the spring extends outside of a first opening of the side of the exterior surface of the bottom unit in a first relaxed position and temporarily and removably locks to the top unit to the bottom unit in the first relaxed position;

an indentation ring of the liner of the bottom unit wherein the indentation ring secures the spring and prevents the spring from moving upward or downward with respect to the liner;

wherein the spring remains completely within the interior surface of the bottom unit in a second compressed position; and wherein the spring extends more than one hundred and eighty degrees around the liner.

2. The container for storing items of claim 1 further comprising:

a first opening on the side of the top unit wherein the portion of the spring which extends out of the first opening of the side of the exterior surface of the bottom unit temporarily and removably locks into the first opening of the side of the top unit and locks the top unit to the bottom unit.

3. The container for storing items of claim 1 further comprising:

a ribbed portion on the exterior surface of the bottom unit wherein the ribbed portion provides a gripping surface for twisting the bottom unit with respect to the top unit.

4. The container for storing items of claim 1 wherein the spring is a compression spring which is compressed when the exterior surface of the bottom unit is compressed.

5. The container for storing items of claim 2 further comprising:

an extended protrusion located directly above or directly below the opening of the top unit wherein the extended protrusion is capable of allowing the pulling of the top unit away from the bottom unit.

6. The container for storing items of claim 1 further comprising:

a second opening on the side of the exterior surface of the bottom unit wherein the second opening is directly across from the first opening of the side of the exterior surface of the bottom unit.

7. The container for storing items of claim 2 further comprising:

a second opening on the side of the top unit wherein the second opening of the top unit is directly across from the first opening of the side of the top unit.

8. The container for storing items of claim 1 wherein the liner is permanently secured to the exterior surface of the bottom unit.

9. The container for storing items of claim 1 wherein an air-tight seal is created between the top unit and the bottom unit when the top unit is secured to the bottom unit.

10. The container for storing items of claim 1 wherein the spring has a first end and a second end and wherein the first end and the second end are curved and wherein the curved first end and the curved second end force the spring away from the liner and toward an interior wall of the exterior surface of the bottom unit.

11. The container for storing items of claim 1 further comprising:

a removable liner secured to an underside of the top unit wherein the removable liner acts as a gasket and creates an air-tight seal between the top unit and the bottom unit when the top unit is secured to the bottom unit.

12. The container for storing items of claim 1 further comprising:

a curved top rim of the bottom unit which curves over and secures a top rim of the liner.

13. The container for storing items of claim 1 further comprising:

a raised rim along the perimeter of the top unit wherein the raised rim has an underside which receives a rim of the bottom unit and secures the top unit to the bottom unit.

* * * * *